US008684750B1

(12) United States Patent
Lin

(10) Patent No.: US 8,684,750 B1
(45) Date of Patent: Apr. 1, 2014

(54) CONTACT TYPE OF ELECTRIC CONNECTION BUILDING BLOCK AND ELECTRIC CONNECTION UNIT DISPOSED THEREIN

(71) Applicant: Chia-Yen Lin, Dongguan (CN)

(72) Inventor: Chia-Yen Lin, Dongguan (CN)

( * ) Notice: Subject to any disclaimer, the term of this patent is extended or adjusted under 35 U.S.C. 154(b) by 0 days.

(21) Appl. No.: 13/952,675

(22) Filed: Jul. 29, 2013

(51) Int. Cl.
*H01R 12/00* (2006.01)

(52) U.S. Cl.
USPC ..... 439/66

(58) Field of Classification Search
USPC ..... 439/66, 75, 82, 124, 928; 446/91; 361/729, 730
See application file for complete search history.

(56) References Cited

U.S. PATENT DOCUMENTS

| | | | | |
|---|---|---|---|---|
| 5,054,778 | A * | 10/1991 | Maleyko | 473/570 |
| 6,050,044 | A * | 4/2000 | McIntosh | 52/591.1 |
| 6,146,168 | A * | 11/2000 | Ishii | 439/188 |
| 7,063,587 | B1 * | 6/2006 | Lin | 446/124 |
| 7,997,907 | B2 * | 8/2011 | Tutt et al. | 439/66 |
| 8,348,469 | B2 * | 1/2013 | Mrakovich et al. | 362/294 |
| 8,371,894 | B1 * | 2/2013 | Rosen et al. | 446/91 |
| 8,403,532 | B2 * | 3/2013 | Yamashita et al. | 362/249.02 |
| 2003/0063463 | A1 * | 4/2003 | Sloan et al. | 362/238 |
| 2012/0036748 | A1 * | 2/2012 | Yen | 40/541 |
| 2013/0109268 | A1 | 5/2013 | Lin | |

FOREIGN PATENT DOCUMENTS

| | | | |
|---|---|---|---|
| EP | 0 117 846 | A1 | 9/1984 |
| GB | 2 188 956 | A | 10/1987 |
| WO | WO 86/01343 | A1 | 2/1986 |
| WO | WO 2010/009731 | A2 | 1/2010 |

OTHER PUBLICATIONS

EP 13178418.3 Search Report.

* cited by examiner

*Primary Examiner* — Alexander Gilman
(74) *Attorney, Agent, or Firm* — Lin & Associates IP, Inc.

(57) ABSTRACT

A contact type of electric connection building block includes an electric connection unit, which has an electronic device and electronic connection posts mounted on a circuit board of the electronic device. The electric connection unit is modularized, and the first and second electrodes of the electric connection post are provided with the contact portions to be connected with the circuit board of the electronic device. Thus, it does not need soldering and reduces environmental contamination. Moreover, when the first and second electrodes of a building block are respectively connected with the first and second electrodes of another building block, the first and second insertion portions could provide stable and accurate contact effect. Furthermore, the electric connection post only needs the post member and the first and second electrodes to assemble. It greatly reduces the numbers of components, simplifies assembling processes and reduces assembling time.

10 Claims, 8 Drawing Sheets

CONTACT TYPE OF ELECTRIC CONNECTION BUILDING BLOCK AND ELECTRIC CONNECTION UNIT DISPOSED THEREIN

BACKGROUND OF THE INVENTION

1. Field of the Invention

The present invention relates generally to an electric connection unit, and in particular to an electric connection unit of a contact type of electric connection building block. The present invention further relates to the contact type of electric connection building block.

2. The Prior Arts

Building blocks are a common toy which allows players to use imagination and creativity to construct various models. There are a variety of ways to play the building blocks. Therefore, the building blocks are always popular in the market. At present, there are electric connection building blocks available in the market. The electric connection building block includes electronic components, such as LED lights and audio components, a circuit board, and electric connection posts disposed therein. When a plurality of electric connection building blocks are connected with each other, the electronic components are electrically connected by the circuit board and the electric connection posts, such that the electrically connected electric connection building blocks would emit light or play sound (i.e. activate the electronic components disposed therein), which provides more entertainment and fun.

The conventional electric connection building blocks, such as Taiwan Utility Model Patent No. M408402, include electric connection posts mounted on a circuit board. The electric connection post includes a positive conducting member and a negative conducting member. Each of the positive and negative conducting members has a metal lead. The metal leads are soldered on the circuit board and connected with the electronic components by the circuit board.

However, the positive and negative conducting members of the electric connection posts of the electric connection building blocks have a complex structure and a lot of components. It is hard and time consuming to assemble. Furthermore, the positive and negative conducting members need to be soldered on the circuit board by the spot soldering. Not only labor consuming, but also it would cause environmental contamination. Therefore, there are problems needed to be solved.

SUMMARY OF THE INVENTION

To overcome the disadvantages of conventional designs, a primary objective of the present invention is to provide an electric connection unit of a contact type of electric connection building block, which is easy to assemble, environmental friendly and less labor consuming.

In order to achieve the objective, an electric connection unit of a contact type of electric connection building block according to the present invention includes: an electronic device having a circuit board and an electronic component disposed on the circuit board; and a plurality of electric connection posts mounted on the circuit board. The electric connection posts are connected with the electronic component by the circuit board. Each of the electric connection posts includes a post member, a first electrode and a second electrode. The post member is electrically insulating. The first and second electrodes are disposed in the electric connection post and spaced away from each other in an axial direction. The first electrode includes a contact portion laterally projected out of the post member. The second electrode is bent at a middle portion thereof, and a top end and a bottom end of the second electrode are located at two axes, respectively. The second electrode includes a contact portion laterally projected out of the post member. The contact portions of the first and second electrodes are pressed against the circuit board, respectively.

Another objective of the present invention is to provide a contact type of electric connection building block, which is also easy to assemble, environmental friendly and less labor consuming.

In order to achieve the objective, a contact type of electric connection building block according to the present invention includes: a main body having a base and a top cover disposed on the base.

The electric connection unit mentioned above is disposed between the base and the top cover. Tops of the electric connection posts of the electric connection unit are pressed against the top cover. The contact portions of the first and second electrodes are pressed against the circuit board of the electronic device, respectively. Moreover, the circuit board of the electronic device of the electric connection unit is pressed against the base.

The electric connection unit according to the present invention is modularized, and the first and second electrodes of the electric connection post are provided with the contact portions to be connected with the circuit board of the electronic device. Thus, it does not need soldering and reduces environmental contamination. Moreover, the electric connection post only needs the post member, the first electrode and the second electrode to complete the assembly. Therefore, it greatly reduces the numbers of components, simplifies assembling processes and reduces assembling time.

Preferably, the post member includes a first insertion portion and a second insertion portion corresponding to the first insertion portion. The first and second insertion portions are formed at two end of the post member, respectively. Therefore, when the first and second electrodes of a building block are respectively connected with the first and second electrodes of another building block, the first and second insertion portions could provide stable and accurate contact effect.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
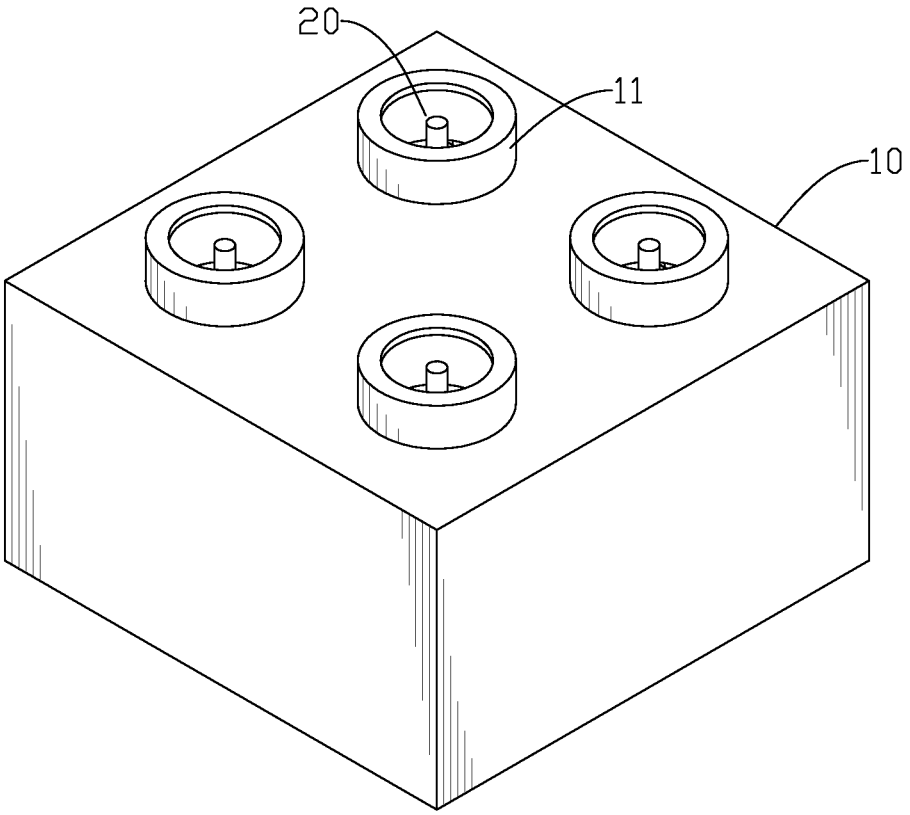
FIG. 1 is a perspective view showing a contact type of electric connection building block according to a first embodiment of the present invention.
Figure 2:
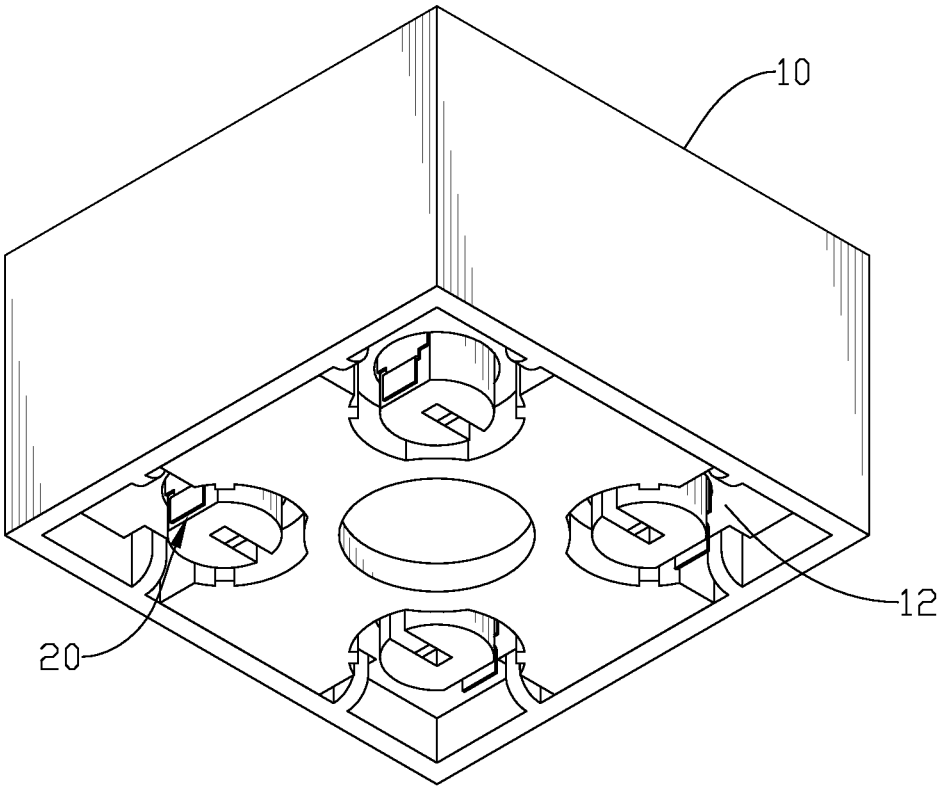
FIG. 2 is a bottom perspective view showing the contact type of electric connection building block according to the first embodiment of the present invention.

With reference to FIGS. 1 and 2, a contact type of electric connection building block according to a first preferred embodiment of the present invention includes a main body 10 and an electric connection unit 20.

Figure 3:
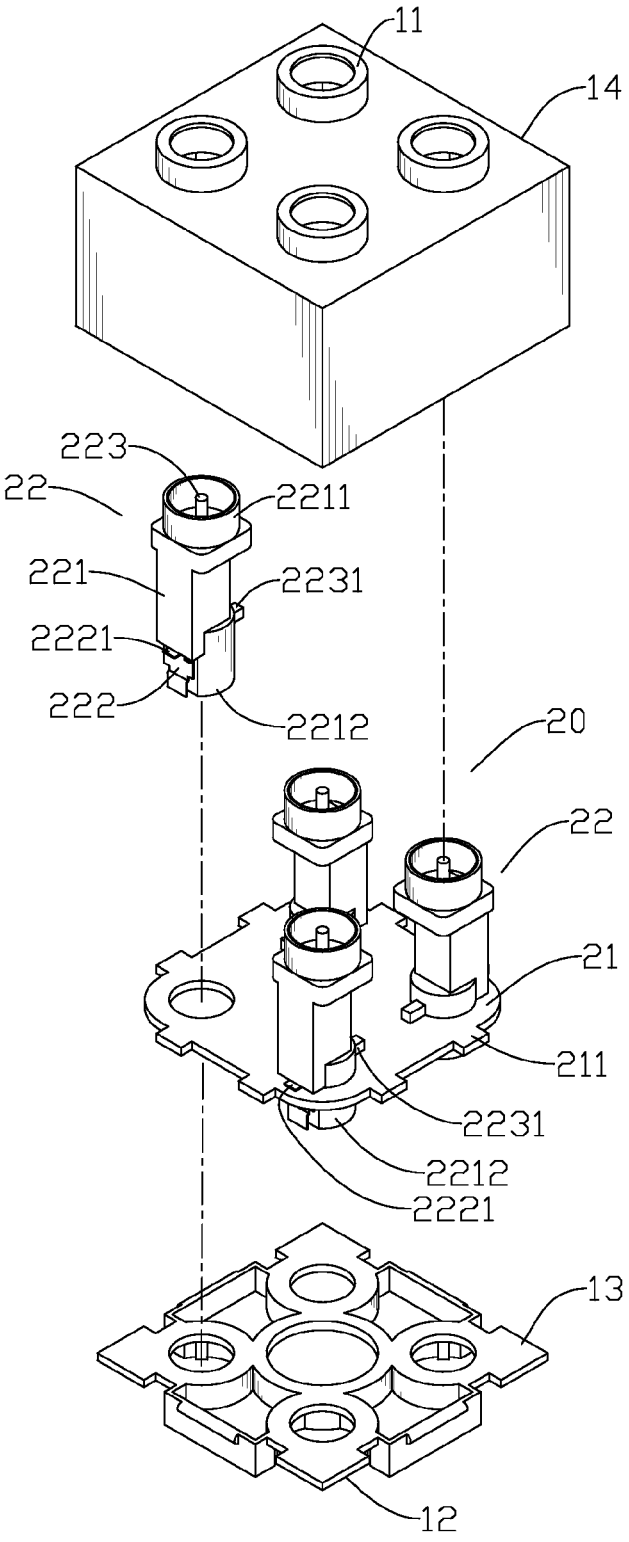
FIG. 3 is an exploded view showing the contact type of electric connection building block according to the first embodiment of the present invention.

As shown in FIGS. 1 to 3, the main body 10 is hollow and includes a base 13 and a top cover 14 disposed on the base 13. A plurality of hollow studs 11 are formed and spaced at intervals on the top cover 14 and a plurality of recesses 12 are formed and spaced at intervals in a bottom of the base 13.

Referring to FIGS. 1 to 5, the electric connection unit 20 is disposed between the base 13 and the top cover 14, and includes an electronic device 21 and a plurality of electric connection posts 22. The electronic device 21 has a circuit board 211 and an electronic component 212 mounted on the circuit board 211. The electric connection posts 22 are inserted into the circuit board 211 and electrically connected with the electronic component 212 through the circuit board 211. Tops of the electric connection posts 22 of the electric connection unit 20 are pressed against the top cover 14. Moreover, the circuit board 211 of the electronic device 21 of the electric connection unit 20 is pressed against a top of the base 13. Each of the electric connection posts 22 comprises a post member 221, a first electrode 222 and a second electrode 223.

Figure 4:
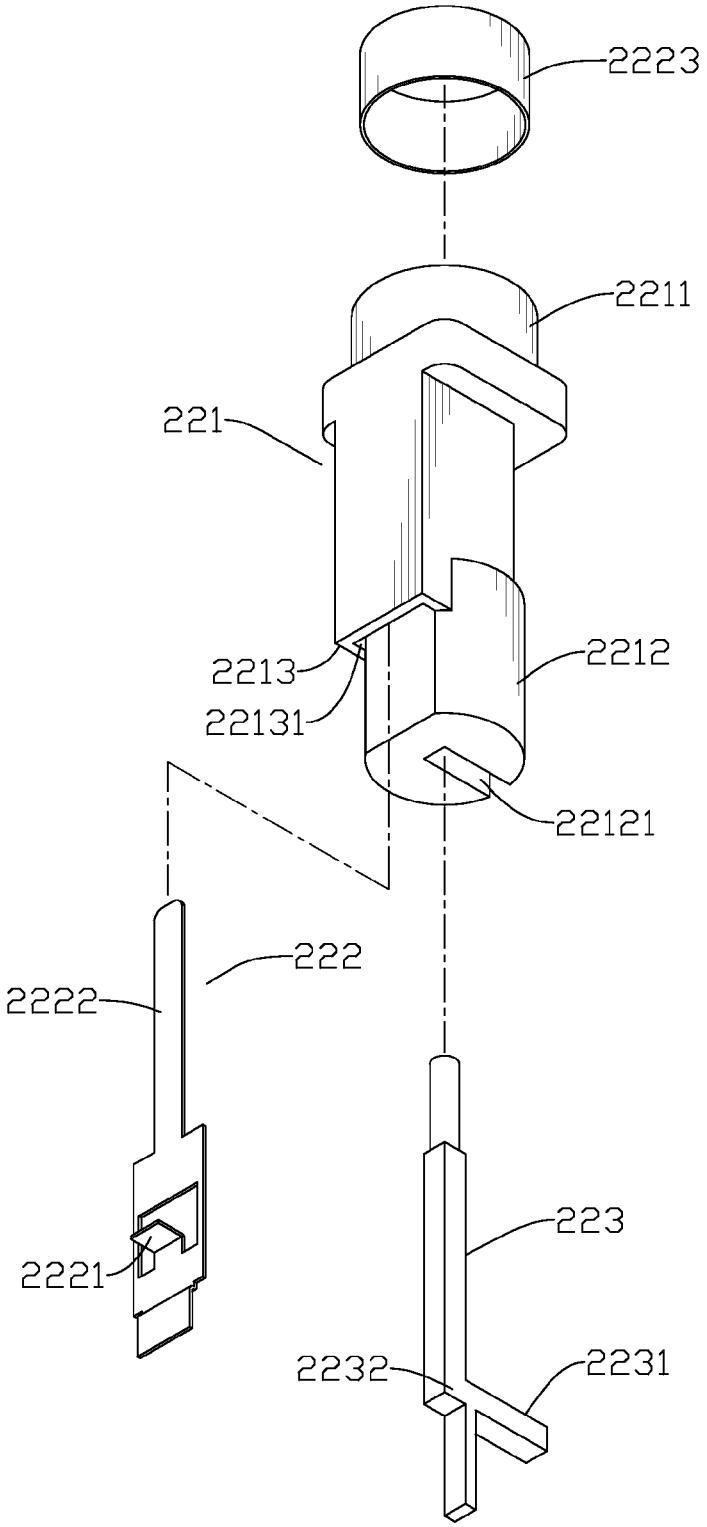
FIG. 4 is an exploded view showing an electric connection post according to the first embodiment of the present invention.
Figure 5:
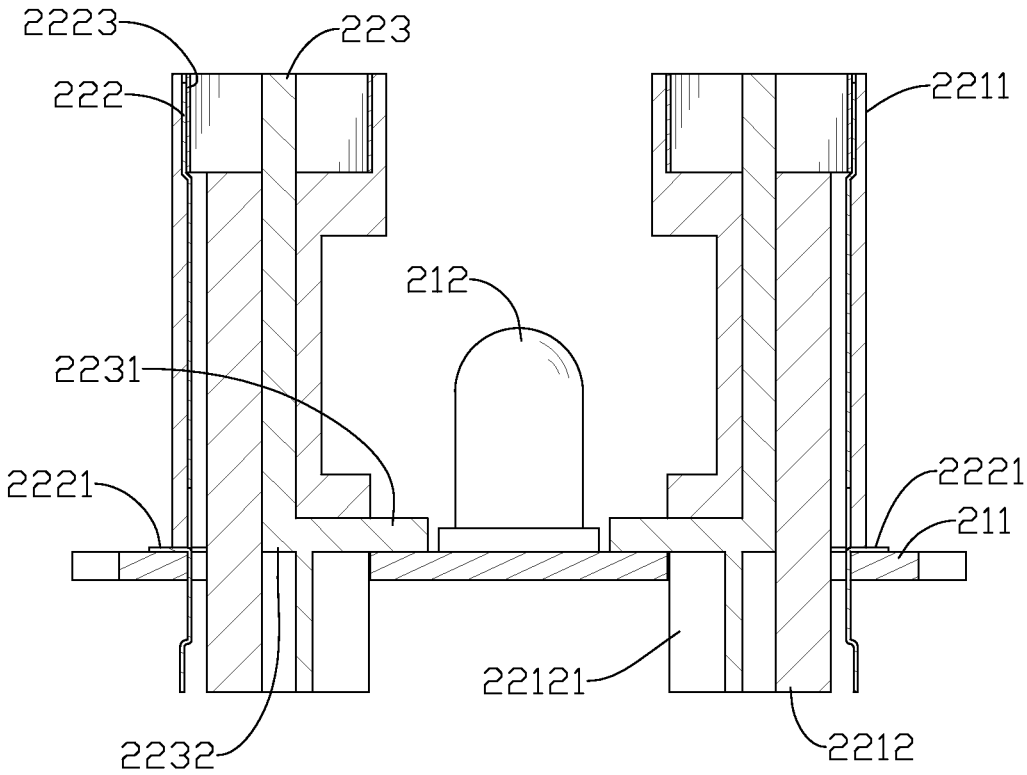
FIG. 5 is a cross-sectional view showing the contact type of electric connection building block according to the first embodiment of the present invention.

As shown in FIGS. 3 to 5, the post member 221 is electrically insulating. The post member 221 has a first insertion portion 2211 and a second insertion portion 2212 corresponding to the first insertion portion 2211. The first insertion portion 2211 and the second insertion portion 2212 are disposed at two ends of the post member 221, respectively. The first insertion portions 2211 of the post members 221 of the electric connection posts 22 are located in the hollow studs 11 of the top cover 14 of the main body 10 and are pressed against the hollow studs 11 of the top cover 14 of the main body 10, respectively. The second insertion portions 2212 of the post members 221 of the electric connection posts 22 are located in the recesses 12 of the base 13 of the main body 10, respectively. The first electrode 222 and the second electrode 223 are disposed at the post member 221 and spaced away from each other in the axial direction, such that the first electrode 222 is insulated from the second electrode 223. The first electrode 222 includes a contact portion 2221 extended outward from the post member 221 and pressed against the circuit board 211 of the electronic device 21. The second electrode 223 includes a contact portion 2231 extended outward from the post member 221 and pressed against the circuit board 211 of the electronic device 21. The contact portion 2221 of the first electrode 222 and the contact portion 2231 of the second electrode 223 are located at the same level relative to the circuit board 211 of the electronic device 21.

According to the first preferred embodiment, the post member 221 of the electric connection post 22 is integrally formed as shown in FIGS. 4 and 5. The first insertion portion 2211 and the second insertion portion 2212 of the post member 22 are an insertion sleeve and an insertion cylinder, respectively. The second insertion portion 2212 of the post member 221 is recessed from an end edge thereof to form a slot 22121. The second electrode 223 goes through the slot 22121 and axially passes through the post member 221. The contact portion 2231 of the second electrode 223 passes through the slot 22121 to be projected out of the post member 221 and is pressed against a top of the circuit board 211 of the electronic device 21. In the meanwhile, the second electrode 223 is bent at a middle portion 2232 thereof, such that a top end and a bottom end of the second electrode 223 are located at different axes. Moreover, the second insertion portion 2212 of the post member 221 is provided with an insertion section 2213 disposed at a side thereof. The insertion section 2213 has an insertion opening 22131. The first electrode 222 includes an electrode body 2222 and an electric connection loop 2223. The electrode body 2222 goes through the insertion opening 22131 and axially passes through the post member 221. A top end of the electrode body 2222 is located in the first insertion portion 2211 of the post member 221 and a bottom end of the electrode body 2222 is located outside of the second insertion portion 2212 of the post member 221. The contact portion 2221 of the first electrode 222 is projected out of the electrode body 2222 and pressed against the insertion section 2213. The electric connection loop 2223 is connected with the top end of the electrode body 2222, and the electric connection loop 2223 of the first electrode 222 is disposed adjacent to an inner side surface of the first insertion portion 2211 of the post member 221. The top end of the electrode body 2222 is located between the electric connection loop 2223 and the first insertion portion 2211.

The electronic component 212 of the electronic device 21 disposed in the electric connection unit 20 may be audio members, light members or various chips. In order to activate the electronic component 212, the main body 10 should be equipped with the characteristics corresponding to the electronic component 212. For example, if the electronic component 212 is an audio member, the main body 10 should be pervious to sound. If the electronic component 212 is a light member as shown in FIG. 5, the main body 10 should be pervious to light.

Figure 6:
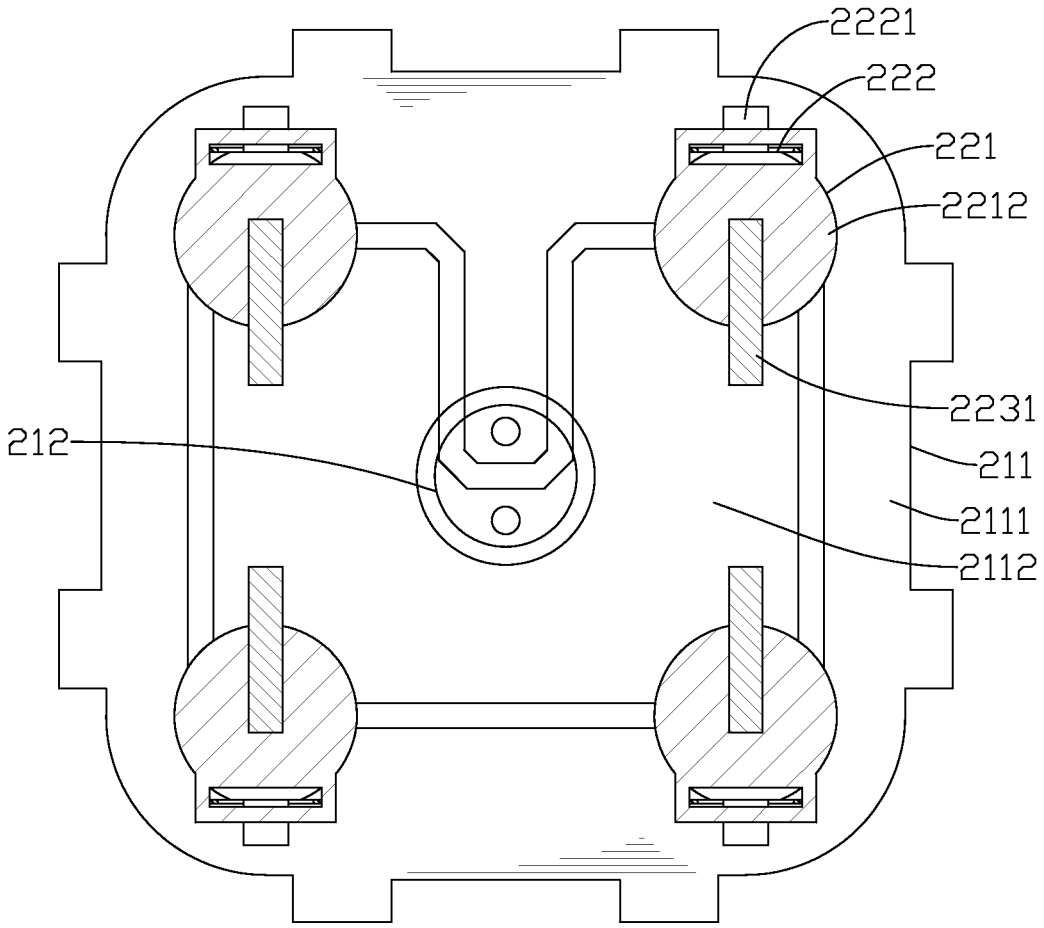
FIG. 6 is a bottom view showing the contact type of electric connection building block according to the first embodiment of the present invention.

Referring to FIGS. 3 and 6, a first connection circuit 2111 and a second connection circuit 2112, which is separated from the first connection circuit 2111, are formed on the surface of the circuit board 211 of the electronic device 21. The electronic component 212 is connected with the first connection circuit 2111 and the second connection circuit 2112. The contact portion 2221 of the first electrode 222 is pressed against the first connection circuit 2111 and the contact portion 2231 of the second electrode 223 is pressed against the second connection circuit 2112.

Referring to FIG. 6, the second connection circuit 2112 is formed at a center of the circuit board 211 and the first connection circuit 2111 is formed at a periphery of the second connection circuit 2112 and not contacted with the second connection circuit 2112. The contact portion 2221 of the first electrode 222 and the contact portion 2231 of the second electrode 223 are projected out of two opposite sides of a wall of the post member 221. The contact portions 2231 of the second electrodes 223 are facing towards the center of the circuit board 211 and the contact portions 2221 of the first electrodes 222 are facing towards the periphery of the circuit board 211. The configuration of the contact portions of the electrodes are not limited to the embodiment mentioned above. For example, the first connection circuit 2111 is formed at a center of the circuit board 211 and the second connection circuit 2112 is formed at a periphery of the first connection circuit 2111 and not contacted with the first connection circuit 2111. The contact portions 2221 of the first electrodes 222 are facing towards the center of the circuit board 211 and the contact portions 2231 of the second electrodes 223 are facing towards the periphery of the circuit board 211.

Figure 7:
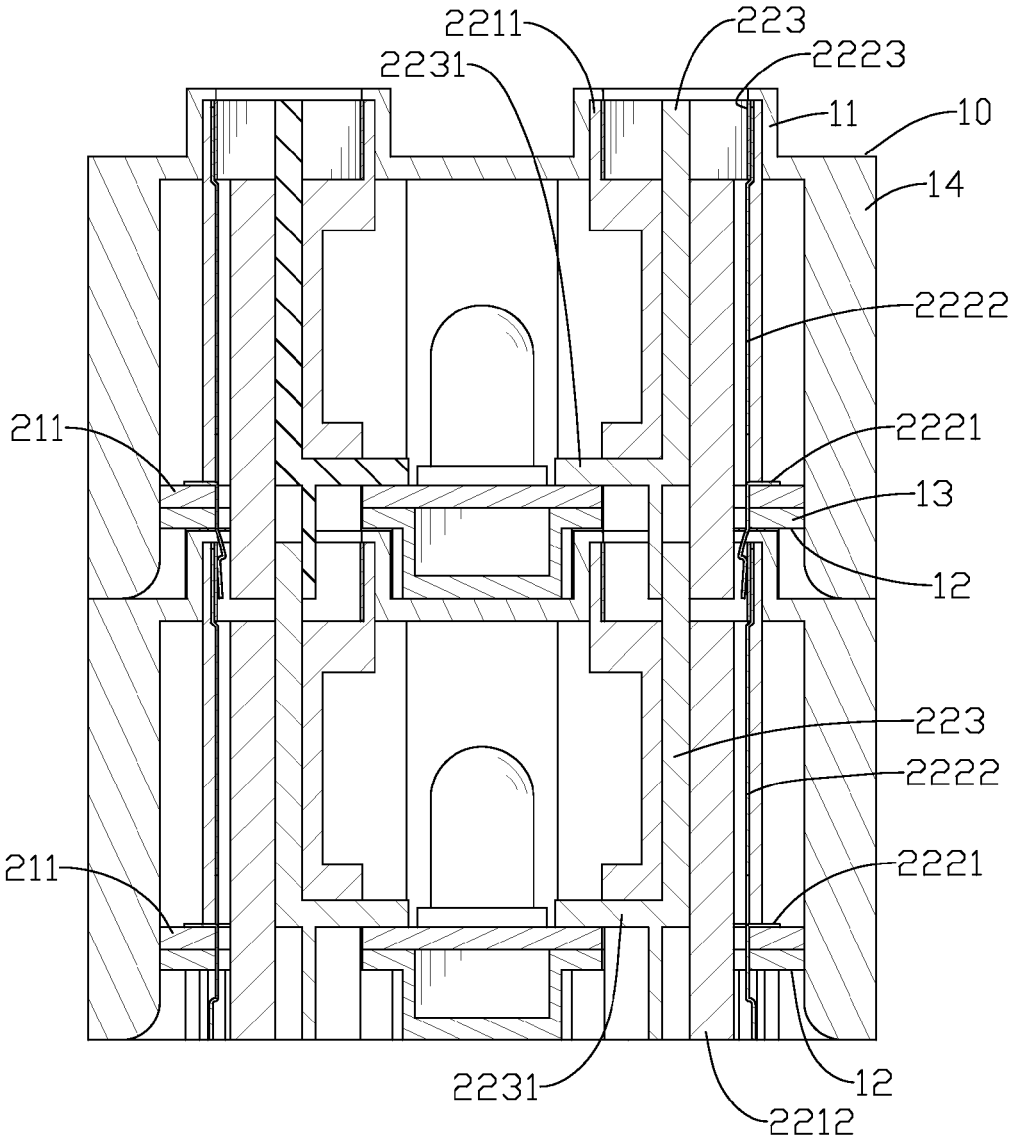
FIG. 7 is a cross-sectional view showing the connected contact type of electric connection building blocks according to the present invention.

As shown in FIGS. 3 to 6, when assembling the electric connection unit 20 according to the first embodiment, it only needs to insert the electrode body 2222 of the first electrode 222 into the insertion opening 22131 of the insertion section 2213, so that the first electrode passes through and connect with the post member 221. The contact portion 2221 is pressed against the insertion section 2213 and projected out of the post member 221. Then, the electric connection loop 2223 is disposed in the first insertion portion 2211 and contacted with the electrode body 2222. Then, the second electrode 223 is inserted into the post member 221, so that the contact portion 2231 of the second electrode 223 is projected out of the post member 221 through the slot 22121. After that, the contact portions 2221 of the first electrodes 222 of the electric connection posts 22 are aligned with the first electric connection circuit 2111 of the circuit board 211 of the electronic device 21, and the contact portions 2231 of the second electrodes 223 of the electric connection posts 22 are aligned with the second electric connection circuit 2112 of the circuit board 211 of the electronic device 21. The electric connection posts 22 are inserted to and connected with the circuit board 211. Then, the contact portion 2221 of the first electrode 222 is pressed against the first connection circuit 2111 and the contact portions 2231 of the second electrode 223 are pressed against the second connection circuit 2112, so that the assembly of the electric connection unit 20 is finished. Please further referring to FIG. 7, the electric connection unit 20 is assembled in the main body 10, so that the first insertion portions 2211 of the post members 221 of the electric connection posts 22 are located in the hollow studs 11 of the top cover 14 of the main body 10 and the second insertion portions 2212 of the post members 221 of the electric connection posts 22 are located in the recesses 12 of the base 13 of the main body 10. Then, the base 13 is securely connected with the top cover 14, preferably by ultrasonic welding, thereby finishing the assembling of the contact type of electric connection building blocks.

When connecting two contact type of electric connection building blocks with each other, the hollow studs 11 of the top cover 14 of the main body 10 of a second building block are inserted into the recesses 12 of the base 13 of a first building block as shown in FIGS. 3, 4, 5 and 7. The second insertion portions 2212 of the electric connection posts 22 of the first building block are inserted into the corresponding first insertion portions 2211 of the electric connection post 22 of the second building block. The bottom ends of the electrode bodies 2222 of the first electrodes 222 of the first building block are inserted into the corresponding first insertion portions 2211 of the electric connection posts 22 of the second building block and in contact with the corresponding electric connection loops 2223 of the first electrodes. The top ends of the second electrodes 223 of the second building block are axially inserted into the corresponding slots 22121 of the second insertion portions 2212 of the first building block and disposed between the corresponding walls of the slots 22121 and the second electrodes 223. Moreover, the sides of the top ends of the second electrodes 223 are in contact with the corresponding sides of the bottom ends of the second electrodes 223. Therefore, the first and second connection circuits 2111 and 2112 of the first building block are electrically connected with the first and second connection circuits 2111 and 2112 of the second building block by the contact connection of the electric connection posts 22. The configuration of the first insertion portion 2211, the second insertion portion 2212 and the slot 22121 provide stable and accurate contact effect when the first and second electrodes 222 and 223 of the first building block connect with the first and second electrodes 222 and 223 of the second building block.

Figure 8:
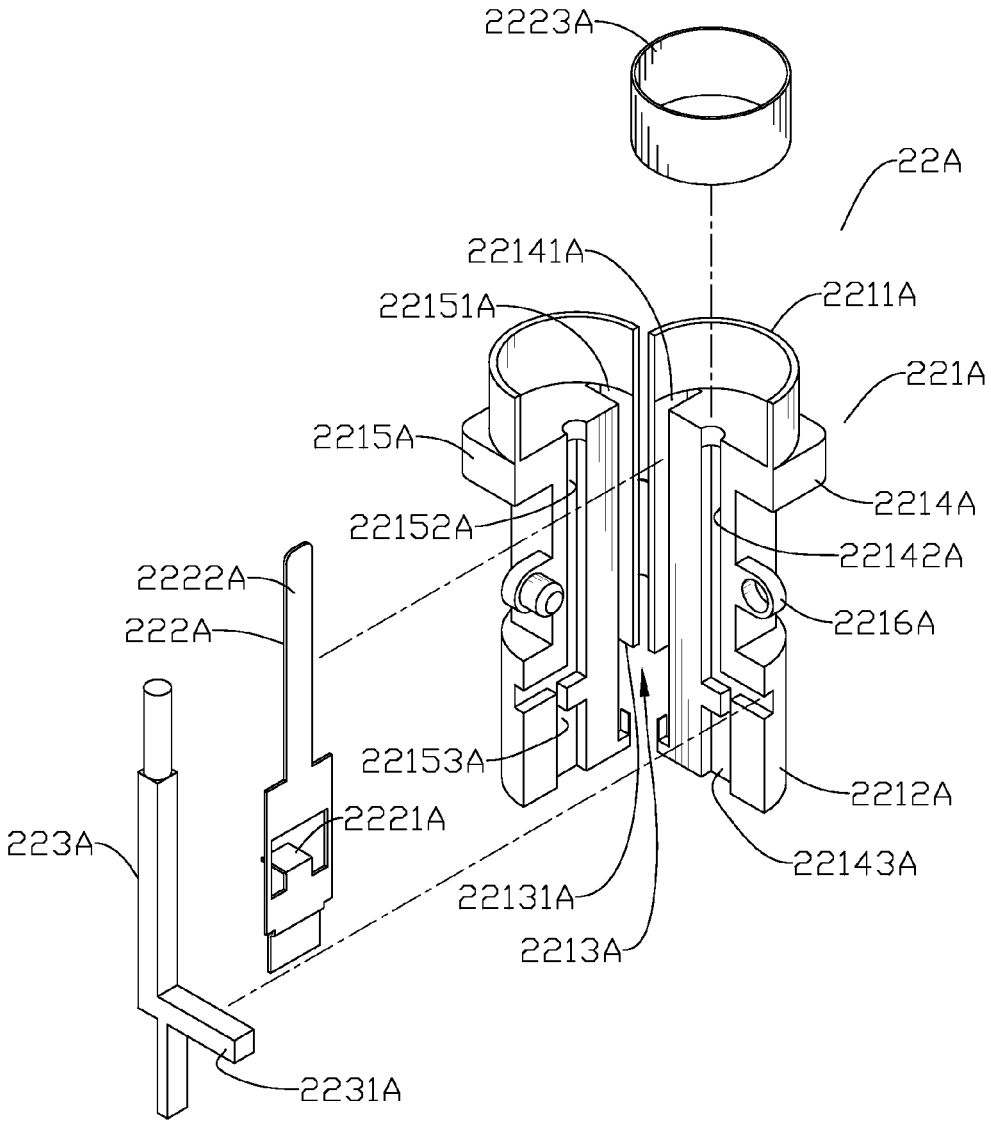
FIG. 8 is an exploded view showing an electric connection post according to a second embodiment of the present invention.

Referring to FIG. 8, a post member 221A of an electric connection post 22A according to a second preferred embodiment of the present invention includes a first half piece 2214A, a second half piece 2215A and a joining piece 2216A. The joining piece 2216A connects the first half piece 2214A with the second half piece 2215A. The first half piece 2214A is axially recessed to form a first installation portion 22141A and a second installation portion 22142A spaced away from each other. The second half piece 2215A is axially recessed to form a first installation portion 22151A and a second installation portion 22152A spaced away from each other. The first installation portion 22141A of the first half piece 2214A and the first installation portion 22151A of the second half piece 2215A communicate with each other, and the second installation portion 22142A of the first half piece 2214A and the second installation portion 22152A of the second half piece 2215A communicate with each other. A bottom of the second installation portion 22142A of the first half piece 2214A is biased laterally to form an insertion part 22143A and thus a step difference is defined between the bottom and a top of the second installation portion 22142A. A bottom of the second installation portion 22152A of the second half piece 2215A is biased laterally to form an insertion part 22153A and thus a step difference is defined between the bottom and a top of the second installation portion 22152A. The insertion part 22143A of the first half piece 2214A and the insertion part 22153A of the second half piece 2215A communicate with each other. An insertion section 2213A and an insertion opening 22131A are formed between the bottoms of the first installation portion 22141A and 22151A and a second insertion portion 2212A. An electrode body 2222A of a first electrode 222A is disposed between the first installation portions 22141A and 22151A. A contact portion 2221A of the first electrode 222A is pressed against the insertion section 2213A. A second electrode 223A is disposed between the second installation portions 22142A and 22152A and the bottom of the second electrode 223A is disposed between the insertion parts 22143A and 22153A.

As shown in FIG. 8, when assembling the electric connection post 22A according to the second embodiment, first of all, the electrode body 2222A of the first electrode 222A is placed in the first installation portion 22141A of the first half piece 2214A and the contact portion 2221A is projected out of the post member 221A through the insertion opening 22131A of the insertion section 2213A. Secondly, the electric connection loop 2223A is disposed in the first insertion portion 2211A and contacted with the top end of the electrode body 2222A. Thirdly, the second electrode 223A is placed in the second installation portion 22142A of the second half piece 2214A. Fourthly, the second half piece 2215A is aligned with and connected with the first half piece 2214A. Therefore, the electrode body 2222A of the first electrode 222A is received in the first installation portion 22141A of the first half piece 2214A and the first installation portion 22151A of the second half piece 2215A, and the second electrode 223A is received in the second installation portion 22142A of the first half piece 2214A and the second installation portion 22152A of the second half piece 2215A. Finally, the first half piece 2214A and the second half piece 2215A are securely connected with each other by the joining piece 2216A.

When connecting two contact type of electric connection building blocks according to the second preferred embodiment with each other, the top ends of the second electrodes 223A of the electric connection posts 22A of the second building block are inserted into the corresponding second insertion portions 2212A of the electric connection posts 22A of the first building block through the insertion parts 22143A and 22153A of the first and second half pieces 2214A and 2215A. Therefore, the top ends of the second electrodes 223A of the second building block are precisely positioned in the second insertion portion 2212A of the first building block.

Furthermore, the shapes of the first installation portion 22141A of the first piece 2214A and the first installation portion 22151A of the second piece 2215A are corresponding to that of the electrode body 2222A of the first electrode 222A. The shapes of the second installation portion 22142A and 22152A are corresponding to that of the second electrode 223A. Therefore, the present invention could improve the convenience and accuracy of the assembly.

To summarize, the electric connection unit 20 according to the present invention is modularized, and the first and second electrodes 222 and 223 of the electric connection post 22 are respectively provided with the contact portions 2221 and 2231 to be connected with the circuit board 211 of the electronic device 21. Thus, it does not need soldering and reduces environmental contamination. Moreover, the electric connection post 22 only needs the post member 221, the first electrode 222 and the second electrode 223 to complete the assembly. Therefore, it greatly reduces the numbers of components, simplifies assembling processes and reduces assembling time. Besides, when the first and second electrodes 222 and 223 of a contact type of electric connection building block are respectively connected with the first and second electrodes 222 and 223 of another contact type of electric connection building block, the first and second insertion portions 2211 and 2212 could provide stable and accurate contact effect.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A contact type of electric connection building block, comprising:

a main body including a base and a top cover disposed above the base; and an electric connection unit disposed between the base and the top cover, the electric connection unit including:

an electronic device having a circuit board and an electronic component mounted on the circuit board; and a plurality of electric connection posts mounted on the circuit board and electrically connected with the electronic component by the circuit board, each of the electric connection posts including an electrically insulating post member, a first electrode and a second electrode disposed at the post member and spaced away from each other in an axial direction, each of the first and second electrodes including a contact portion laterally projected out of the post member;

wherein tops of the electric connection posts are pressed against the top cover, the circuit board is pressed against the contact portions of the first and second electrodes to force the contact portions of the first and second electrodes to be respectively pressed against the post members so that the contact portions of the first and second electrodes are held between the circuit board and the post members.

2. The electric connection unit building block as claimed in claim 1, wherein the contact portion of the first electrode and the contact portion of the second electrode are located at the same level relative to the circuit board of the electronic device.

3. The electric connection building block as claimed in claim 1, wherein the post member comprises a first insertion portion and a second insertion portion corresponding to the first insertion portion, and the first insertion portion and the second insertion portion are disposed at two ends of the post member, respectively.

4. The electric connection building block as claimed in claim 3, wherein the second insertion portion of the post member of the electric connection post comprises an insertion section disposed at a side thereof, the insertion section includes an insertion opening, the first electrode passes through the insertion opening and axially passes through the post member, and the contact portion of the first electrode is pressed against the insertion section.

5. The electric connection building block as claimed in claim 4, wherein the first electrode includes an electrode body and an electric connection loop, the electrode body passes through the insertion opening and axially passes through the post member, a top end of the electrode body is located in the first insertion portion of the post member and a bottom end of the electrode body is located outside of the second insertion portion of the post member, the contact portion of the first electrode is projected from the electrode body, the electric connection loop is connected with the top end of the electrode body, and the electric connection loop of the first electrode is disposed in the first insertion portion of the post member.

6. The electric connection building block as claimed in claim 3, wherein the post member of the electric connection post is integrally formed, the second insertion portion of the post member is recessed from an end edge thereof to form a slot, the second electrode passes through the slot and axially passes through the post member, and the contact portion of the second electrode is projected out of the post member through the slot.

7. The electric connection building block as claimed in claim 1, wherein the post member of the electric connection post comprises a first half piece, a second half piece and a joining piece, the first half piece is axially recessed to form a first installation portion and a second installation portion spaced away from each other, the second half piece is axially recessed to form a first installation portion and a second installation portion spaced away from each other, the first installation portion of the first half piece is communicated with the first installation portion of the second half piece, and the second installation portion of the first half piece is communicated with the second installation portion of the second half piece, the joining piece connects the first half piece with the second half piece, the first electrode is received in the first installation portion of the first half piece and the first installation portion of the second half piece, and the second electrode is received in the second installation portion of the first half piece and the second installation portion of the second half piece.

8. The electric connection building block as claimed in claim 1, wherein the second electrode is bent at a middle portion thereof, and a top end and a bottom end of the second electrode are respectively located at two axes.

9. The electric connection building block as claimed in claim 1, wherein the circuit board comprises a first connection circuit and a second connection circuit separated from the first connection circuit formed on a surface thereof, the electronic component is connected with the first connection circuit and the second connection circuit, the contact portion of the first electrode is pressed against the first connection circuit and the contact portion of the second electrode is pressed against the second connection circuit.

10. The electric connection building block as claimed in claim 1, wherein the base is pressed against the circuit board of the electronic device of the electric connection unit.

* * * * *